United States Patent [19]

Kiedrowski

[11] Patent Number: 4,780,692

[45] Date of Patent: Oct. 25, 1988

[54] CABLELESS SWITCHING ELEMENT FOR WAVEGUIDE HAVING LOW LOSS AND FAST SWITCHING SPEED

[75] Inventor: Paul A. Kiedrowski, Hanover Park, Ill.

[73] Assignee: Motorola, Inc., Schaumburg, Ill.

[21] Appl. No.: 45,338

[22] Filed: May 4, 1987

[51] Int. Cl.[4] ..... H01P 1/12

[52] U.S. Cl. ..... 333/108; 333/26; 333/259

[58] Field of Search ..... 333/101, 105, 108, 258, 333/259, 262; 335/4, 5; 200/153 S

[56] References Cited

U.S. PATENT DOCUMENTS

| | | | |
|---|---|---|---|
| 2,592,551 | 4/1952 | Flarity . | |
| 3,008,098 | 11/1961 | Hill et al. . | |
| 3,009,117 | 11/1961 | Lanctot . | |
| 3,092,788 | 6/1963 | Hanks, Jr. . | |
| 3,141,146 | 7/1964 | Hinlein | 335/4 X |
| 3,178,659 | 4/1965 | Smith et al. . | |
| 3,478,282 | 11/1969 | Smith . | |
| 3,986,148 | 10/1976 | Pollard . | |
| 4,473,806 | 9/1984 | Johnston . | |
| 4,618,840 | 10/1986 | Yee et al. | 333/108 X |
| 4,633,118 | 12/1986 | Kosugi . | |
| 4,652,840 | 3/1987 | Kosugi . | |

FOREIGN PATENT DOCUMENTS 0169048 1/1986 European Pat. Off. .

OTHER PUBLICATIONS

Hewleit Packard Catalog, pp. 77 and 86.
K & L Switch Products Catalog, pp. 4 and 6.
RF Design Magazine, Apr., 1987, p. 2.
Waveline Catalog, p. 4.

*Primary Examiner*—Paul Gensler
*Attorney, Agent, or Firm*—Donald B. Southard; Edward M. Roney; Steven G. Parmelee

[57] ABSTRACT

An improved switching arrangement 10 for waveguide is disclosed which comprises, in combination, a coaxial switch 12 and a unified, multi-port, waveguide interface 14. The coaxial switch 12 has coaxial connectors of a first type (12*a*, 12*b*, 12*c*) mounted in a parallel pattern with a preestablished center-to-center spacing. The waveguide interface 14 includes flanges (14*a*, 14*b*, 14*c*), and is preferably formed as a waveguide housing having a transition plate portion and a cover plate portion. Each port of the unified waveguide interface includes internal waveguide-to-coax transitions for coupling to a respective external connector of a second type. The external coaxial connectors (16*a*, 16*b*, 16*c*) are configured in a parallel pattern with center-to-center spacings equal to the preestablished center-to-center spacings of the coaxial switch connectors (12*a*, 12*b*, 12*c*) such that these connectors mate directly with those of the unified waveguide interface. By so doing, intervening coaxial cables or adaptors are eliminated and relatively low insertion loss and fast switching speed are exhibited over a relatively broad bandwidth.

35 Claims, 3 Drawing Sheets

CABLELESS SWITCHING ELEMENT FOR WAVEGUIDE HAVING LOW LOSS AND FAST SWITCHING SPEED

BACKGROUND OF THE INVENTION

The present invention relates generally to microwave waveguide switches, and more particularly to an improved arrangement for a microwave waveguide switch that utilizes cableless waveguide to coax transitions and a standard coaxial relay. This arrangement combines the advantages of relatively low insertion loss and relatively fast switching speed to provide a high performance microwave waveguide switch at significantly lower cost.

Today's communications systems are requiring higher and higher operating frequencies in view of the crowded radio spectrum at the lower, well established frequencies at VHF, UHF, and low microwave frequencies. In implementing a microwave communications system at a higher microwave frequency, for example at 23 Gigahertz (GHz), the designer is often confronted with the need for a waveguide switching element to implement a transmit-receive (T/R) switch, or similar switch permitting redundant switch-over of a backup component into or out of a waveguide or microwave transmission line. While such T/R switches are readily implemented at VHF or UHF frequencies utilizing relays having coaxial connections, such switches, while exhibiting switching speeds of about 10 milliseconds, are nevertheless more difficult to implement at microwave frequencies.

A first known group of microwave waveguide switches is implemented in either manual or electromechanical switching arrangements in which a relatively large inertial mass is rotated within a cylindrical portion of a waveguide. Such waveguide switches, designed for use in the standard waveguide millimeter bands from 26.5 to 220 GHz, exhibit slow switching speeds, on the order of 50 to 100 milliseconds, and have low loss, generally not above 0.2 decibels (dB). However, the cost of such units is generally in the $700 to $900 range. This cost is significantly higher than the cost of coaxial relay switches, which constitute a second known group of microwave switches, most of which are in the $100 price range.

For midrange microwave frequencies on the order of 23 GHz, neither of the above types of conventionally known transmission line switches is suitable for a microwave communications system requiring low loss, relatively fast switching speed, and reasonable cost. Furthermore, attempting to utilize coaxial relays in conjunction with coaxial cables coupling to and from the relay, the designer is faced with very rapidly rising insertion loss due to the inefficiency of the coaxial cable at such microwave frequencies.

A third known alternative utilizes solid state PIN diodes to implement an electronic switch. PIN diodes are so named because of their structure, which allows them to handle radio frequency (RF) energy with low distortion. These diodes have three layers including a P layer, an intrinsic layer, and an N layer. Such solid state switches have loss, however, in excess of 2.0 dB. While the PIN diode switch exhibits a switching time under 1 millisecond, it falls in the $500–$1,000 price range.

One known improvement describes an ultra-high frequency switch having a plurality of terminals and a moveable conductor for establishing and interrupting inter-connection between the terminals and which is actuated by a solenoid having a coil. This moveable conductor utilizes an elongate and flat center conductor in a strip line configuration to make contact with the plurality of terminals and utilizes an impedance matching arrangement for matching between this strip line and the terminals. Although such an arrangement appears to offer significantly shorter switching time and small size construction, several drawbacks are apparent.

The first disadvantage is that the center conductor and drive rod assembly requires precision alignment and mounting in order to insure non-binding movement of the drive rod. Proper alignment of the center conductor with the portions of the waveguide to strip line transitions is also required.

A second disadvantage is that the region immediately surrounding the center conductor, which is required for its movement, also provides a leakage path for microwave signals entering at one waveguide terminal to leak over or loosely couple to the second waveguide terminal when the waveguide switch is in the OFF condition. Although no specific quantity is given for the isolation achieved by this arrangement, most microwave communications systems applications require isolation between ports of a suitable waveguide switch to exceed 40 dB.

A second known arrangement utilizes an electroexpansive element to actuate a first moveable center conductor alternately with a second moveable center conductor in order to connect a stationary common contact to either of a first or a second stationary selection contact. This arrangement describes a single-pole double-throw (SPDT) switch with coaxial connections having moveable center conductor strip line segments similar to the first known arrangement. This second known arrangement is able to achieve the SPDT switch structure with only one actuator, but suffers from the previously mentioned disadvantages related to the internal structure thereof. Each of the disadvantages listed above, therefore, leads to serious compromises in microwave communication system performance, all of which are undesirable and wasteful.

Accordingly, there exists a need for an improved switching element for waveguide which combines the advantages of relatively low insertion loss and relatively fast switching speed and having a simplified assembly with few moving parts in order to enhance the reliability and electrical performance thereof. There exists a further need to provide the above mentioned waveguide switching element which is easily repaired in the event of electrical or mechanical failure therein.

SUMMARY OF THE INVENTION

It is an object of the present invention to provide an improved microwave switching arrangement for waveguide which combines the advantages of relatively low insertion loss and relatively fast switching speed and which overcomes the foregoing deficiencies.

It is a further object of the present invention to provide an improved switching arrangement for waveguide of the foregoing type which ensures a maximum amount of isolation between ports of the waveguide and which furthermore facilitates repair of the waveguide switch in the event of mechanical or electrical failure therein.

In practicing one form of the invention, a particular waveguide switching arrangement is disclosed which combines a single-pole double-throw coaxial switch characterized at the microwave frequency band having first, second, and third coaxial connectors configured in a pattern parallel to each other and mounted orthogonal to a planar surface thereof, a triple waveguide-to-coax interface housing having three waveguide ports separated by two partitions, with each waveguide port including an internal multi-stepped impedance transformer as a waveguide-to-coax transition therein and coupled to a respective one of three coaxial connectors. Each coaxial connector mounts on the triple waveguide-to-coax interface housing and contains an extended center post surrounded by dielectric The extended center post couples to a respective one of the internal multi-stepped impedance transformers, such that the three coaxial connectors mounted on the triple waveguide-to-coax interface housing mate directly to the first, second, and third connectors of the coaxial switch, notably without a need for intervening coaxial cables or adaptors, thereby providing a single-pole double-throw waveguide switch which exhibits relatively low insertion loss and relatively fast switching speed over a broad range of microwave frequencies.

In practicing an alternate form of the waveguide switching arrangement, each of the waveguide-to-coax transitions comprises an impedance transformer formed without steps but having a back partition constructed and arranged to be in proximity to a respective center post of a given coaxial connector. This center post is surrounded by dielectric and extends within the transition to effect the impedance match.

Alternate variations of this basic form of waveguide switching arrangement are possible, including those with as few as two ports, as well as those having multiple combinations of single-pole, double-throw switches.

These and other objects of the present invention will become apparent to those skilled in the art upon consideration of the accompanying specification, claims and drawings.

BRIEF DESCRIPTION OF THE DRAWINGS

Referring to the drawings, wherein like reference numerals indicate like elements in these several figures and in which.

DETAILED DESCRIPTION OF THE PREFERRED EMBODIMENT

Figure 1:
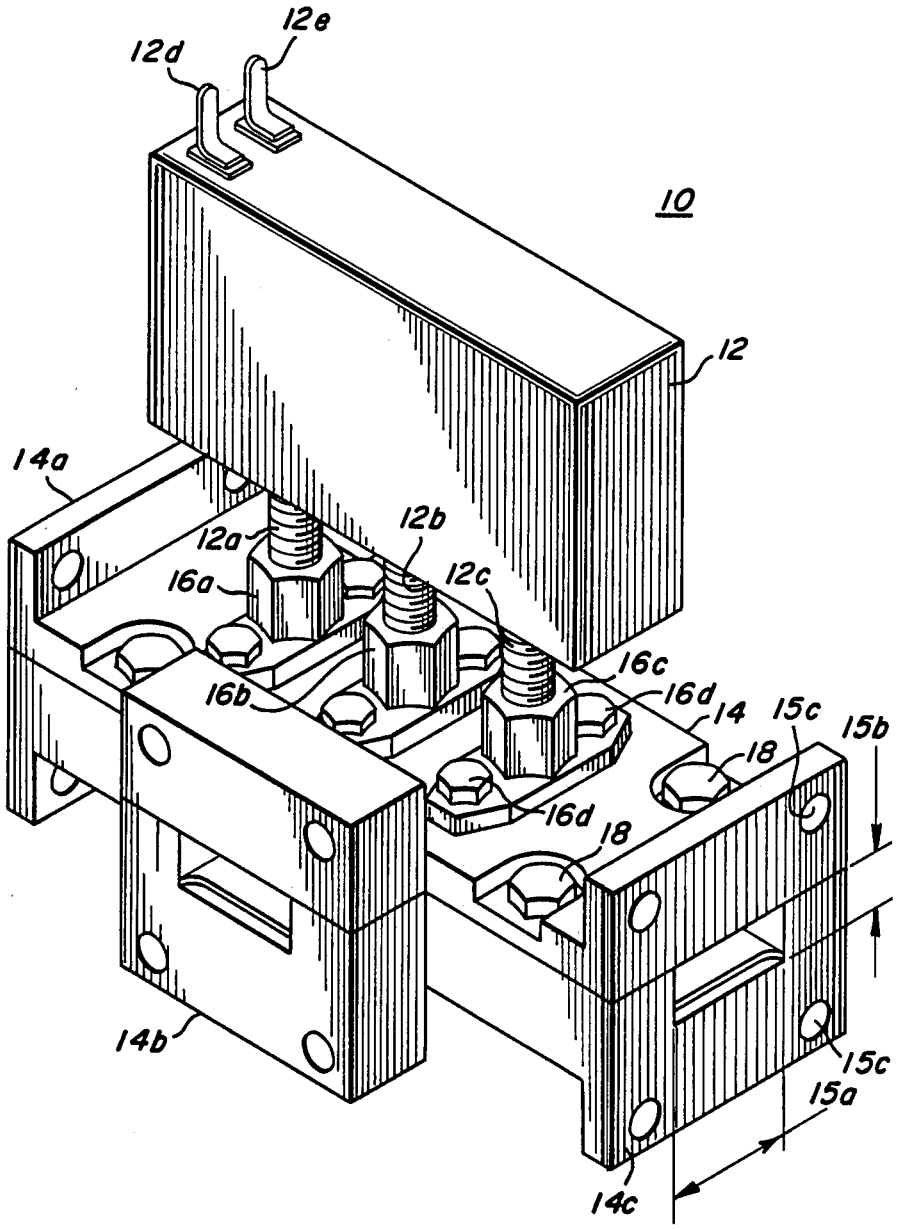
FIG. 1 is a perspective view of the first embodiment of the present invention depicting the coaxial switch mounted on the triple waveguide-to-coax interface housing having three waveguide ports separated by partitions.

Referring now to the drawings, FIG. 1 at 10 shows a waveguide switching arrangement according to the first embodiment of the present invention. As shown, it includes a commercially available coaxial relay 12, and a unified, multi-port, waveguide interface 14 having three waveguide ports with flanges 14*a*, 14*b*, and 14*c*.

Coaxial relay 12 includes any failsafe or latching relay and any of several types (here depicted as single-pole double-throw, or SPDT, configuration), available from various suppliers such as RLC Electronics, K & L Switch Products, etc.

Each of flanges 14*a*, 14*b*, and 14*c* include a waveguide port having width and height dimensions defined by 15*a* and 15*b* respectively. These flanges conform to the dimensions for standard UG595/U flanges, and include four through-holes 15*c*. Each of the waveguide ports, represented by 15*a*, 15*b* is coupled to a respective coaxial connector 16*a*, 16*b*, and 16*c* which, in turn, mates with a respective coaxial connector on coaxial switch 12, depicted as 12*a*, 12*b*, and 12*c*. Each of the coaxial connectors 16*a*, 16*b*, and 16*c* are held in place by suitable mounting screws 16*d*, here depicted as having hexagonal shaped heads. This multi-port waveguide interface 14 comprises a brass or cast zinc-alloy waveguide housing plated with silver and consists of an upper portion and a lower portion held together by mounting screws 18, such as those depicted having hexagonal heads, as shown.

Figure 2:
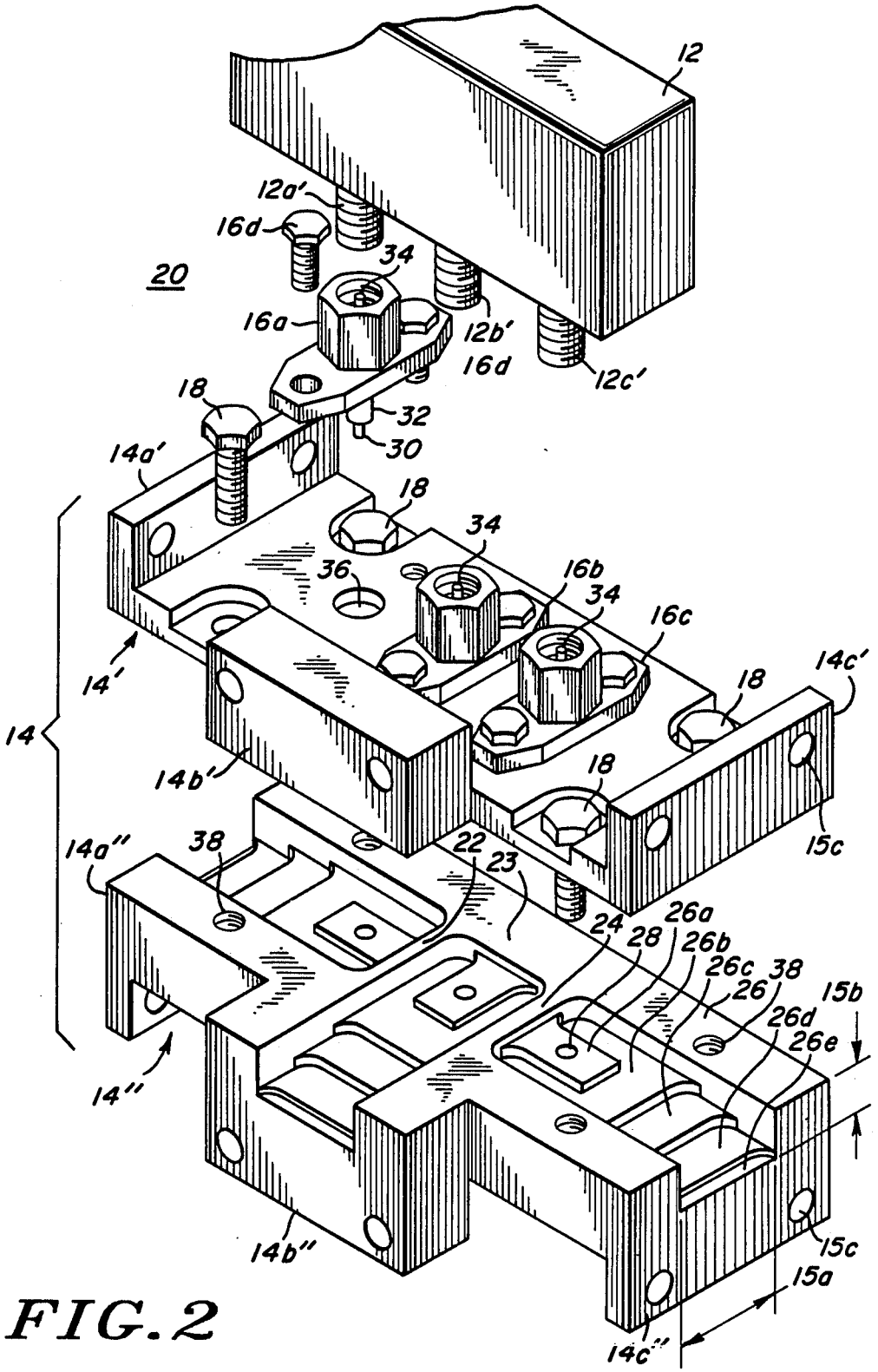
FIG. 2 is an exploded view of the first embodiment of the present invention.

FIG. 2 at 20 depicts a more detailed drawing rendered as an exploded view. Like numerals are employed for corresponding components, where these are applicable. In this drawing, it is seen that coaxial switch 12 includes threaded, miniature coaxial connectors 12*a*', 12*b*', 12*c*', such as type SMA connectors, which are well known to designers of components operating in the UHF or microwave frequency spectrum. Alternate connectors may be utilized, such as type APC-3.5 connectors. Next, the multi-port, waveguide interface 14 includes an essentially planar coverplate portion 14' and transition plate portion 14''. As shown, each of the waveguide ports 14*a*, 14*b*, and 14*c* are split into upper and lower portions, depicted as 14*a*', 14*b*', 14*c*', and 14*a*'', 14*b*'', 14*c*'', respectively.

As can be seen, partition 22 is situated between the waveguide ports represented by flange portions 14*a*'' and 14*b*''. Partition 23 provides a back partition, or wall, at the end of the generally rectangular cavity area leading to waveguide port 14*b*''. Partition 24 is shown between the waveguide ports represented by the cavity areas leading to the waveguide flange portions represented by 14*b*'' and 14*c*''.

In the first embodiment, each of these cavity areas is fabricated to provide impedance transitioning from 50 ohms to $Z_g$, the impedance of a given waveguide. As is well known, the impedance of the waveguide is functionally related to the physical size of the waveguide, the mode of operation, and the operating frequency above a cutoff frequency. Thus, for $TE_{10}$ mode, which designates a transverse electric mode, and WR42 rectangular waveguide having inner dimensions of 0.420 inches for 15*a* and 0.170 inches for 15*b*, $$Z_g = \frac{377}{\sqrt{1 - (f_c/f)^2}},$$

where $f_c = 14.061$ GHz.

For $f = 22.4$ GHz (approx.), $Z_g = 484$ ohms. As is well known, WR42 waveguide is suitable for use at communications frequencies of approximately 18.0–26.5 GHz.

Such an impedance transitioning arrangement is suitable for bandwidths approximating an octave and is formed as a series of steps represented by 26*a*, 26*b*, 26*c*, 26*d*, and 26*e*. For clarity in rendering the drawing, only waveguide port 14*c* has been labeled with these transition steps 26*a*–26*e*, even though it should be understood by one of skill in the art that the transition steps depicted for ports 14*a* and 14*b* are identically constructed. It is recommended that at least two steps be included, in order to provide satisfactory impedance matching for operating bandwidths approaching an octave.

Each of the first steps 26a is fabricated to exhibit 50 ohms characteristic impedance and includes hole 28 for accommodating center pin 30 having a surrounding dielectric sleeve 32 as part of miniature coaxial connectors 16a, 16b, and 16c. It is to be understood that center conductor 30 connects to center pin 34, which is shown as part of miniature coaxial connectors 16a–16c, as shown. Four screws 18 are shown for clamping together the cover plate portion 14' to the ransition plate portion 14" via four threaded holes 38. Note that, although the various screws 16d and 18 are rendered as having hexagonal shaped heads, other suitable screws with slotted or other type heads may also be used.

In constructing this first embodiment of the waveguide-to-coax interface, it is important that the alignment of the cover plate portion 14' and the transition plate portion 14 be maintained so that the alignment of the coaxial connector center pin 30 through hole 36 properly aligns with the holes 28. Furthermore, the construction of the impedance matching transition steps requires that these steps be closely maintained with respect to top surface 26 of the transition plate portion. Each of steps 26a–26e is approximately recessed from top surface 26 according to the following table:

TABLE 1

| | |
|---|---|
| step 26a | .03" |
| step 26b | .06" |
| step 26c | .10" |
| step 26d | .14" |
| step 26e | .17" |

The depth of each transition step 26a–26e, with respect to a given flange surface such as 14b", is shown in the next table, table 2. Steps 26b, 26c, and 26d represent approximate quarter-wavelength sections that effect a gradual, broad-bandwidth impedance match between 50 ohms and 484 ohms (step 26a and step 26e, respectively):

TABLE 2

| | |
|---|---|
| step 26a | .87" |
| step 26b | .57" |
| step 26c | .39" |
| step 26d | .22" |
| step 26e | .04" |

In addition, each of the prongs of "horseshoe shaped" step 26b is approximately 0.12 inches wide. Each of holes 28 is preferably drilled with a #55 drill bit having 0.052 inches diameter and drilled to a depth of 0.25 inches, in order to accommodate center pin 30 of miniature coaxial connector 16a. Hole 36 through coverplate portion 14' is sized to accommodate the dielectric 32 surrounding center pin 30 of the miniature coaxial connector. A preferred diameter for hole 36 is made utilizing a #20 drill bit having a diameter of 0.161 inches. Screws 18, which fasten the coverplate portion to the transition plate portion via mounting holes 38, are 4–40 hardware of suitable length, as shown. Each of the flanges 14a–14c include four through holes. These through holes may be formed by either drilling with a #43 drill bit having a diameter of 0.089 inches and suitable for tapping a 4–40 thread, or may merely be drilled with a #32 drill bit having a diameter of 0.116 inches, to accommodate clearing a #4 machine screw there through.

Both the transition plate portion and the cover plate portion may be constructed using conventionally known techniques. One known method for constructing the unified waveguide housing includes machining a suitable material, such as a copper-alloy like brass, or aluminum, to include the multi-stepped impedance transformers. Another known method includes casting a suitable base material, such as a zinc-alloy, to form the waveguide housing. Either of the waveguide housings so constructed may then be plated with a good conductive material, such as silver, to minimize loss.

After constructing the cover plate portion and the transition plate portion, and mounting the miniature coaxial connectors 16a–16c, the assembly is ready to accept the coaxial relay switch 12 by fastening each of the connectors 16a–16c to the respective connectors 12a–2c which are part of coaxial relay 12. Because the coaxial relay 12 in this embodiment is a single-pole double-throw switch, center connector 12b represents the single pole to be connected to either of coaxial connectors 12a or 12c, the assembled waveguide switch effectively couples waveguide port 14b to either of waveguide ports 14a or 14c when energizing the relay leads 12d, 12e. Moreover, the structure of this arrangement includes partitions 22 and 24, which ensure good isolation between the waveguide ports. As a result, the isolation characterized for the coaxial relay at microwave frequencies (typically >50 dB) is maintained throughout when utilizing this waveguide switch arrangement.

Figure 3:
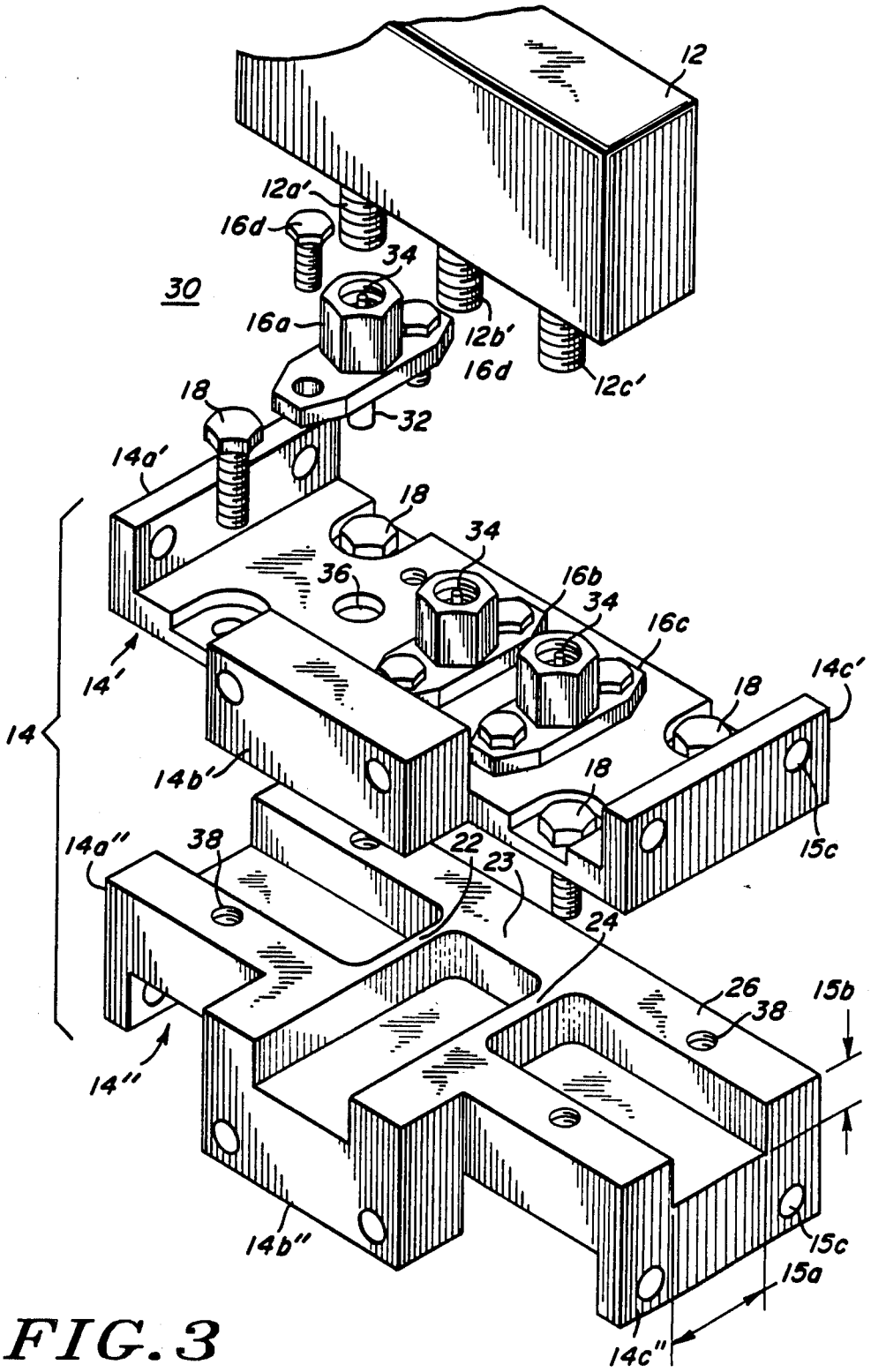
FIG. 3 is an exploded view of an alternate embodiment of the present invention.

An alternate embodiment of the waveguide switching element of the present invention is shown at 30 in FIG. 3, in which each waveguide-to-coax transition is accomplished without a multi-step impedance transformer, as in FIG. 2. This alternate embodiment simplifies the construction of the triple waveguide-to-coax interface housing, at the cost of sacrificing some bandwidth. This waveguide-to-coax transition is preferable for bandwidths under 20% and is in the form of a probe which is part of miniature coaxial connector 16a, with a center post surrounded by dielectric 32 and positioned approximately one-quarter wavelength away from a shorting iris, or back partition 23. By adjusting the center post length, (or probe depth) in combination with judiciously choosing the spacing between the probe center line and the shorting iris, a relatively broad bandwidth coupling is effected. Although a quarter-wavelength in WR-42 waveguide of a signal at 22.4 GHz is approximately 0.16", an optimized set of values suitable for matching over the 20.2–24.6 GHz band was found to be:

| | |
|---|---|
| probe depth = | .10 inches, and |
| probe center-line to shorting-iris spacing = | .10 inches. |

The performance achieved with the second embodiment is summarized as follows:

TABLE 3

| | |
|---|---|
| MEASURED FREQUENCY BAND: | 21.2–23.6 GHz |
| INPUT RETURN LOSS (dB): | >14 dB |
| INSERTION LOSS (max. dB): | <1.0 dB |
| ISOLATION (input to open side): | >50 dB |
| ISOLATION (between outputs): | >70 dB |
| SWITCHING TIME (milliseconds): | <10 msec |

Thus, this waveguide switching arrangement, like the one in FIG. 2, provides a device suitable for T/R or redundant switchover applications at microwave communications frequencies by combining the advantages of relatively low insertion loss and relatively fast switching speed. Moreover, it accomplishes the essential features of the disclosed invention in a cost-effective manner. Repair is also readily facilitated by either of these arrangements, by virtue of the coaxial connectors utilized.

In summary, each of the above mentioned exemplary arrangements is able to provide a high performance switching element in waveguide without compromising insertion loss or switching speed. Thus, each is able to overcome the limitations of the known prior art.

Although these arrangements disclose many of the attendant advantages, it is understood that various changes and modifications not depicted herein are apparent to those of skill in the art. Among such modifications contemplated is the substitution of double ridged waveguide in place of the standard rectangular waveguide. Double ridged waveguide offers much broader operating bandwidths of well over an octave. One example is WRD750D24 waveguide, which is suitable for use at communications frequencies of approximately 7.5–18.0 GHz. Therefore, even though the form of the above-described invention is merely a preferred or exemplary embodiment given with suggested alternatives, further variations may be made in the form, construction, and arrangement of the parts without departing from the scope of the above invention.

I claim:

1. Apparatus or providing a switching element in waveguide which combines the advantages of relatively low insertion loss and relatively fast switching speed, the apparatus comprising in combination:

coaxial switch means having relatively fast switching speed and including at least first, second, and third coaxial connectors of a first type which are mounted orthogonally to an external planar surface thereof in a parallel pattern with a preestablished center-to-center spacing; and unified, multi-port, waveguide interfacing means, including at least three waveguide ports separated by partitions, with each port having internal waveguide-to-coax transition means for coupling to a respective one of at least three external coaxial connectors of a second type mounted orthogonally, to an outer planar surface thereof, and said waveguide interfacing means having one waveguide inner dimension less than the preestablished center-to-center spacing of the coaxial connectors on said coaxial switch means, said external coaxial connectors also configured in a parallel pattern with a center-to-center spacing equal to the preestablished center-to-center spacing of the coaxial connectors on said coaxial switch means, such that the first, second, and third connectors thereon mate directly with the external coaxial connectors on said waveguide interfacing means without intervening coaxial cables or adaptors, thereby providing a switching element for waveguide which exhibits relatively low insertion loss and relatively fast switching speed.

2. The apparatus according to claim 1, wherein said coaxial switch means comprises a single-pole, coaxial relay switch having at least double-throw.

3. The apparatus according to claim 1, wherein said coaxial switch means includes at least three coaxial connectors with center-to-center spacing approximately 0.44 inches, and wherein said waveguide interfacing means couples to waveguide having inner dimensions of WR42 waveguide, typically 0.42 inches by 0.17 inches.

4. The apparatus according to claim 1, wherein said unified, multi-port, waveguide interfacing means comprises a waveguide housing with at least two partitions therein, and wherein each of said waveguide-to-coax transition means includes a multi-stepped impedance transformer fabricated as part of said waveguide housing.

5. The apparatus according to claim 1, wherein each of said waveguide-to-coax transition means comprises a multi-stepped impedance transformer coupled to a respective coaxial connector and having 5 steps for providing broad bandwidth impedance matching.

6. The apparatus according to claim 1, wherein each of said waveguide-to-coax transition means comprises a multi-stepped impedance transformer coupled to a respective coaxial connector and having at least two steps for providing impedance matching for bandwidths approximating an octave.

7. The apparatus according to claim 1, wherein each of said waveguide-to-coax transition means comprises an impedance transformer formed by having said partition constructed and arranged to be in proximity to said coaxial connector of the second type within said transition means.

8. The apparatus according to claim 1, wherein said unified, multi-port, waveguide interfacing means comprises a suitable machined conductive waveguide housing, including a copper-alloy, plated with a good conductive material, including silver, and includes a transition plate portion with at least two partitions therein and a cover plate portion.

9. The apparatus according to claim 1, wherein said unified, multi-port waveguide interfacing means comprises a suitable machined conductive waveguide housing, including aluminum, plated with a good conductive material, including silver, and includes a transition plate portion with at least two partitions therein and a cover plate portion.

10. The apparatus according to claim 1, wherein said unified, multi-port, waveguide interfacing means comprises a suitable cast base material, including zinc-alloy, formed as a waveguide housing plated with a good conductive material, including silver, and includes a transition plate portion with at least two partitions therein and a cover plate portion.

11. The apparatus according to claim 1, wherein said unified, multi-port, waveguide interfacing means comprises a waveguide housing having flanges suitable for coupling to rectangular waveguide, including WR42, for use at communications frequencies of approximately 18.0–26.5 GHz.

12. The apparatus according to claim 1, wherein said unified, multi-port, waveguide interfacing means comprises a waveguide housing having flanges suitable for coupling to ridged waveguide, including WRD750D24, for use at communications frequencies of approximately 7.5–18.0 GHz.

13. An improved waveguide switch, which combines the advantages of relatively low insertion loss and relatively fast switching speed, suitable for use in communications equipment operating in a microwave frequency band, comprising in combination:

a single-pole, double-throw coaxial, relay switch characterized at the microwave frequency band, having first, second, and third female coaxial connectors which are configured in a pattern parallel to each other and mounted orthogonally to a planar surface thereof;

a triple waveguide-to-coax interface housing having three waveguide ports separated by two partitions, with each waveguide port including a waveguide-to-coax transition therein; and three male coaxial connectors, each coaxial connector having an extended center post surrounded by dielectric and mounted on said triple waveguide-to-coax interface housing so as to electrically couple the extended center post to a respective one of said waveguide-to-coax transitions, said three coaxial connectors on said triple waveguide-to-coax interface housing also configured in a pattern parallel to each other and mounted orthogonally to a planar surface thereof so as to mate directly to the first, second, and third connectors of said coaxial switch notably without intervening coaxial cables or adaptors, thereby providing a single-pole double-throw waveguide switch which exhibits relatively low insertion loss and relatively fast switching speed at frequencies in the microwave frequency band.

14. The improved waveguide switch according to claim 13, wherein said coaxial switch comprises a readily available switch having miniature connectors thereon, including female type SMA connectors, spaced approximately 0.44 inches center-to-center.

15. The improved waveguide switch according to claim 13, wherein said coaxial switch comprises a readily available switch having miniature connectors thereon, including female type APC-3.5 connectors, spaced approximately 0.44 inches center-to-center.

16. The improved waveguide switch according to claim 13, wherein said triple waveguide-to-coax interface housing comprises a machined conductive waveguide housing, including a copper-alloy, plated with a good conductive material, including silver, and includes a transition plate portion with two partitions therein and a cover plate portion.

17. The apparatus according to claim 13, wherein said triple waveguide-to-coax interface housing comprises a machined conductive waveguide housing, including aluminum, plated with a good conductive material, including silver, and includes a transition plate portion with two partitions therein and a cover plate portion.

18. The improved waveguide switch according to claim 13, wherein said triple waveguide-to-coax interface housing comprises a suitable cast base material, including a zinc-alloy, formed as a waveguide housing plated with a good conductive material, including silver, and includes a transition plate portion with two partitions therein and a cover plate portion.

19. The improved waveguide switch according to claim 13, wherein each of said waveguide-to-coax transitions includes 5 steps for providing broad bandwidth impedance matching.

20. The improved waveguide switch according to claim 13, wherein each of said waveguide-to-coax transitions comprises a multi-stepped impedance transformer having at least two steps for providing relatively broad bandwidth impedance matching for bandwidths approximating an octave.

21. The improved waveguide switch according to claim 13, wherein each of said waveguide-to-coax transitions comprises an impedance transformer formed by having said partition constructed and arranged to be in proximity to a center post of said male coaxial connector within said impedance transformer

22. The improved waveguide switch according to claim 13, wherein said coaxial connectors comprise miniature connectors, including male type SMA connectors, spaced approximately 0.44 inches center-to-center on said interface housing.

23. The improved waveguide switch according to claim 13, wherein said coaxial connectors comprise miniature connectors, including male type APC-3.5 connectors, spaced approximately 0.44 inches center-to-center on said interface housing.

24. Apparatus for providing a switching element for waveguide which combines the advantages of relatively low insertion loss and relatively fast switching speed, the apparatus comprising in combination:

coaxial switch means, having relatively fast switching speed and having at least first and second coaxial connectors of a first type mounted in a parallel orientation on an external planar surface thereof; and unified, multi-port, waveguide interfacing means, including at least two waveguide ports separated by a partition, with each port having internal waveguide-to-coax transition means for coupling to a respective one of at least two coaxial connectors of a second type mounted on an outer planar surface thereof, said at least two coaxial connectors of the second type also configured in a parallel orientation on an external planar surface of said waveguide interfacing means such that the first and second connectors on said coaxial switch means mate directly with the coaxial connectors on said waveguide interfacing means without intervening coaxial cables or adaptors, thereby providing a switching element for waveguide which exhibits relatively low insertion loss and relatively fast switching speed.

25. The apparatus according to claim 24, wherein said coaxial switch means comprises a single-pole, coaxial switch having at least a single-throw.

26. The apparatus according to claim 24, wherein said coaxial switch means includes at least two coaxial connectors with center-to-center spacing approximately 0.44 inches, and wherein said waveguide interfacing means couples to waveguide having dimensions of WR42 waveguide, typically 0.42 inches by 0.17 inches.

27. The apparatus according to claim 24, wherein said unified, multi-port, waveguide interfacing means comprises a waveguide housing with at least one partition therein, and wherein each of said waveguide-to-coax transition means includes a multi-stepped impedance transformer fabricated as part of said waveguide housing.

28. The apparatus according to claim 24, wherein each of said waveguide-to-coax transition means comprises a multi-stepped impedance transformer coupled to a respective coaxial connector and having 5 steps for providing broad bandwidth impedance matching.

29. The apparatus according to claim 24, wherein said waveguide-to-coax transition means comprises a multi-stepped impedance transformer coupled to a respective coaxial connector and having at least two steps for providing relatively broad bandwidth impedance matching for bandwidths approximating a octave.

30. The apparatus according to claim 24, wherein said waveguide-to-coax transition means comprises an impedance transformer formed by having said partition constructed and arranged to be in proximity to said coaxial connector of the second type within said transition means.

31. The apparatus according to claim 24, wherein said unified, multi-port, waveguide interfacing means comprises a machined conductive waveguide housing, a copper-alloy, plated with a good conductive material, including silver, and includes a transition plate portion with at least one partition therein and a cover plate portion.

32. The apparatus according to claim 24, wherein said unified, multi-port, waveguide interfacing means comprises a machined conductive waveguide housing, including aluminum, plated with a good conductive material, including silver, and includes a transition plate portion with at least one partition therein and a cover plate portion.

33. The apparatus according to claim 24, wherein said unified, multi-port, waveguide interfacing means comprises a suitable cast base material, including a zinc-alloy, formed as a waveguide housing plated with a good conductive material, including silver, and includes a transition plate portion with at least one partition therein and a cover plate portion.

34. The apparatus according to claim 24, wherein said unified, multi-port, waveguide interfacing means comprises a waveguide housing having flanges suitable for coupling to rectangular waveguide, including WR42, for use at communications frequencies of approximately 18.0–26.5 GHz.

35. The apparatus according to claim 24, wherein said unified, multi-port, waveguide interfacing means comprises a waveguide housing having flanges suitable for coupling to ridged waveguide, including WRD750D24, for use at communications frequencies of approximately 7.5–18.0 GHz.

* * * * *

UNITED STATES PATENT AND TRADEMARK OFFICE

CERTIFICATE OF CORRECTION

PATENT NO. : 4,780,692

DATED : Oct. 25, 1988

INVENTOR(S) : Paul A. Kiedrowski

It is certified that error appears in the above-identified patent and that said Letters Patent is hereby corrected as shown below:

Col. 11, Line 8: After "housing," please insert --including--.

Signed and Sealed this

Eleventh Day of August, 1992

*Attest:*

DOUGLAS B. COMER

*Attesting Officer*

*Acting Commissioner of Patents and Trademarks*